US010890033B1

(12) United States Patent
Crosby et al.

(10) Patent No.: US 10,890,033 B1
(45) Date of Patent: Jan. 12, 2021

(54) KELLY BAR WITH LOCKING FEATURE, RELATED SYSTEM AND METHOD

(71) Applicant: Watson, Incorporated, Fort Worth, TX (US)

(72) Inventors: Mark Allan Crosby, Saginaw, TX (US); Douglas Allan Watson, Aledo, TX (US)

(73) Assignee: Watson, Incorporated, Fort Worth, TX (US)

( * ) Notice: Subject to any disclaimer, the term of this patent is extended or adjusted under 35 U.S.C. 154(b) by 78 days.

(21) Appl. No.: 16/215,500

(22) Filed: Dec. 10, 2018

Related U.S. Application Data

(60) Provisional application No. 62/596,881, filed on Dec. 10, 2017.

(51) Int. Cl.
*E21B 17/00* (2006.01)

(52) U.S. Cl.
CPC ..... *E21B 17/00* (2013.01)

(58) Field of Classification Search
CPC ..... E21B 17/00; F16D 2001/103; F16D 1/112
USPC ..... 464/163; 403/109.2, 109.8, 359.1
See application file for complete search history.

(56) References Cited

U.S. PATENT DOCUMENTS

| | | | | |
|---|---|---|---|---|
| 5,026,704 | A | 6/1991 | Honore et al. | |
| 5,101,914 | A | 4/1992 | Wenzel | |
| 5,368,083 | A * | 11/1994 | Beck, III | E21B 3/04 175/195 |
| 7,007,362 | B2 | 3/2006 | Gibson | |
| 9,937,970 | B2 | 4/2018 | Higashi et al. | |

FOREIGN PATENT DOCUMENTS

| | | | |
|---|---|---|---|
| CN | 104791389 | A | 7/2015 |
| KR | 20120025776 | A | 3/2012 |

* cited by examiner

*Primary Examiner* — Giovanna Wright
*Assistant Examiner* — Yanick A Akaragwe
(74) *Attorney, Agent, or Firm* — McGlinchey Stafford; R. Andrew Patty, II

(57) ABSTRACT

A Kelly bar apparatus includes a plurality of concentric tubes in a telescoping arrangement having either a locking feature provided by a series of keys and notches that interlock selectively, or one or more blocking tabs that prevent complete telescopic extension of at least one of the tubes when the tubes and associated keys are in an unlocked position, or both. Related subterranean bore drilling systems and drilling methods are also described.

19 Claims, 10 Drawing Sheets

KELLY BAR WITH LOCKING FEATURE, RELATED SYSTEM AND METHOD

REFERENCE TO RELATED APPLICATION

A claim is hereby made to the benefit of U.S. provisional patent application 62/596,881, filed on Dec. 10, 2017, the disclosure of which is incorporated herein by reference.

TECHNICAL FIELD

This invention relates to Kelly bars, and associated drilling systems and methods.

THE INVENTION

A Kelly bar is a tubular component of a rotary drilling rig used, for example, in producing a subterranean bore in a geological formation. Kelly bars are intended to concurrently transfer torque from a rotary drive and linear force (sometimes referred to as crowd force) from a linear force system (e.g., a crowd system) to a drilling tool or bit. Telescoping Kelly bars typically have 2-5 tubular sections with varying transverse cross-sectional diameters sequentially arranged in telescopic fashion, with a system of keys and associated lock recesses welded onto or otherwise forming a part of the inner and outer surfaces, respectively, of the tubular sections. The tubular sections are often fabricated of high-tensile steel for a sufficient combination of strength and minimized weight.

However, telescopic Kelly bar designs developed to-date present operational challenges, due to their tendency to unlock unexpectedly, the difficulty in aligning locks, and the resulting wear and tear. In addition, the selective extension and retraction of the telescoping sections in existing designs is often difficult to control during drilling operations. Thus a need exists for improved Kelly bar designs that address these and other problems in the art.

The invention which is the subject of this disclosure addresses one or more of the aforesaid shortcomings of, or otherwise constitute improvements over, existing Kelly bar designs and their related systems and methods.

For example, in one aspect of the invention there is provided a Kelly bar apparatus comprising:

an outer tube that forms an inner surface and a plurality of keys arranged into one or more key groups, wherein each key group is characterized at least such that:

the keys are arranged into a plurality of key sets, each key set comprising at least two (2) keys circumferentially adjacent but spaced apart from one another, and each key extending longitudinally along a portion of the outer tube and radially inwardly from an inner surface of the outer tube, and the key sets are arranged into two or more key sub-groups disposed at different longitudinal positions respectively along the length of the outer tube, each key sub-group being comprised of at least two key sets, the key sets within a given one of the key sub-groups being disposed at the same longitudinal position along the outer tube and being circumferentially spaced apart from one another; and a first inner tube sized and configured to at least partially nest and rotate within and telescopically slide relative to the outer tube, the first inner tube forming an outer surface, wherein the first inner tube further comprises a plurality of flute-like splines circumferentially spaced apart and extended along a longitudinal axis of a portion of the first inner tube and extending radially outwardly from the outer surface of the first inner tube, so as to define at least two fillet-like gaps between respective pairs of the splines; and wherein each key set of the outer tube is sized and configured to slidably engage with a respective one of the gaps between the splines of the first inner tube when the first inner tube is nested within the outer tube and the outer tube is rotationally disposed in an unlocked position permitting telescopic extension of the first inner tube relative to the outer tube, and wherein each key set of the outer tube is sized and configured to fit within a respective notch formed within a respective one of the splines of the first inner tube when the first inner tube is nested within the outer tube and the outer tube is rotationally disposed in a locked position inhibiting telescopic extension of the first inner tube relative to the outer tube.

In a particular aspect of the invention, the first inner tube of the Kelly bar apparatus further comprises at least one blocking tab which extends radially outwardly from the outer surface of the first inner tube and circumferentially around a portion of the first inner tube so as to extend across a longitudinal axis of a respective one of the fillet-like gaps, and to abut a top portion of at least one of the keys of at least one of the key sets of the outer tube when the first inner tube is nested within the outer tube and the outer tube is rotationally disposed in the unlocked position and the first inner tube slides into an extended telescopic position, thereby inhibiting the first inner tube from telescopically extending from the outer tube when the outer tube is rotationally disposed in the unlocked position and at least one of the key sets of the outer tube is disposed in the respective one of the fillet-like gaps across which the blocking tab extends. In at least some aspects of the invention, a lower most abutting surface of the at least one blocking tab is disposed at or adjacent to a longitudinal midpoint of the first inner tube.

In another particular aspect of the invention, the first inner tube of the Kelly bar apparatus forms a first inner tube inner surface and comprises a plurality of keys circumferentially spaced apart from one another, each key extending along a longitudinal axis of a portion of the first inner tube and extending radially inwardly from the inner surface of the first inner tube, and the Kelly bar apparatus further comprises a second inner tube sized and configured to at least partially nest and rotate within and telescopically slide relative to the first inner tube, the second inner tube forming an outer surface thereof, wherein the second inner tube further comprises a plurality of flute-like splines circumferentially spaced apart and extended along a longitudinal axis of a portion of the second inner tube and extending radially outwardly from the outer surface of the second inner tube, so as to define one or more fillet-like gaps between the splines of the second inner tube.

In another aspect, the invention provides a Kelly bar apparatus comprising an outer tube that forms an inner surface and a plurality of keys extending therefrom; and a first inner tube sized and configured to at least partially nest and rotate within and telescopically slide relative to the outer tube, the first inner tube forming an outer surface, wherein the first inner tube further comprises a plurality of flute-like splines circumferentially spaced apart and extended along a longitudinal axis of a portion of the first inner tube and extending radially outwardly from the outer surface of the first inner tube, so as to define at least two fillet-like gaps between respective pairs of the splines;

wherein each key of the outer tube is sized and configured to slidably engage with a respective one of the gaps between the splines of the first inner tube when the first inner tube is nested within the outer tube and the outer tube is rotationally disposed in an unlocked position permitting telescopic extension of the first inner tube relative to the outer tube, and wherein each key of the outer tube is sized and configured to fit within a respective notch formed within a respective one of the splines of the first inner tube when the first inner tube is nested within the outer tube and the outer tube is rotationally disposed in a locked position inhibiting telescopic extension of the first inner tube relative to the outer tube; and wherein the first inner tube further comprises at least one blocking tab which extends radially outwardly from the outer surface of the first inner tube and circumferentially around a portion of the first inner tube so as to extend across a longitudinal axis of a respective one of the fillet-like gaps, and to abut a top portion of at least one or more of the keys of the outer tube when the first inner tube is nested within the outer tube and the outer tube is rotationally disposed in the unlocked position and the first inner tube slides into an extended telescopic position, thereby inhibiting the first inner tube from telescopically extending from the outer tube when the outer tube is rotationally disposed in the unlocked position and at least one of the keys of the outer tube is disposed in the respective one of the fillet-like gaps across which the blocking tab extends.

In another aspect the invention provides a drilling system comprising:

a rotary drive power source, a Kelly bar apparatus in accord with an aspect of this invention, wherein the outer tube of the Kelly bar apparatus is slidably coupled to the rotary drive power source, axial force means for controllably applying an axial force to the outer tube in both directions of a longitudinal axis thereof, lifting means for controllably retracting the innermost tube of the Kelly bar apparatus into a telescopically retracted position, and a drill bit coupled to a terminal end of the innermost tube of the Kelly bar apparatus.

Non-limiting examples of the rotary drive power source include hydraulic drives, mechanical drives, electric drives, and the like. Non-limiting examples of the axial force means include a cylinder driven crowd systems, winch driven crowd systems, chain driven crowd systems, and the like. Non-limiting examples of the lifting means include hoist winches, cable pullers and the like.

Still another aspect of the invention is a method of drilling a subterranean bore in a geologic formation, comprising slidably coupling a Kelly bar apparatus in accord with an aspect of this invention to axial force means for controllably applying an axial force to the outer tube in both directions of a longitudinal axis thereof, and a rotary drive power source to the outer tube of the Kelly bar;

coupling a drill bit to a terminal end of the innermost tube of the Kelly bar apparatus;

rotating the outer tube of the Kelly bar apparatus into an unlocked position so that the first inner tube is placed into an extended telescoping position;

positioning the outer tube of the Kelly bar apparatus so that the keys of the outer tube each align with their respective notch in the splines of the first inner tube and rotating the outer tube into a locked position, and actuating the rotary drive power source to rotate and apply a load to the Kelly bar apparatus while the outer tube is in the locked position and the drill bit is in contact with the formation.

Other features and advantages of certain aspects of the invention will be apparent to those of ordinary skill in the art upon reference to the following detailed description taken in conjunction with the accompanying claims and drawings.

BRIEF DESCRIPTION OF THE DRAWINGS

Like numeric or letter references found across the several figures are used to refer to like parts or components illustrated therein.

FURTHER DETAILED DESCRIPTION OF THE INVENTION

Certain aspects of the invention will now be illustrated with reference to the illustrative drawings on the accompanying figures. The illustrated examples which are described with particularity in this specification are not intended to limit the scope of the invention. Rather, the examples are intended as concrete illustrations of various features and advantages of the invention, and should not be construed as an exhaustive compilation of each and every possible permutation or combination of materials, components, configurations or steps one might contemplate, having the benefit of this disclosure. Similarly, in the interest of clarity, not all features of an actual implementation of a tool, system or related method are described in this specification. It of course will be appreciated that in the development of such an actual implementation, numerous implementation-specific decisions must be made to achieve the developers' specific goals, such as compliance with system-related and economic-related constraints, which may vary from one implementation to another. Moreover, it will be appreciated that while such a development effort might be complex and time-consuming, it would nevertheless be a routine undertaking for those of ordinary skill in the art having the benefit of this disclosure.

It will be appreciated by those of skill in the art having the benefit of this disclosure that the Kelly bar apparatus and its components can vary in size and dimension, depending upon the requirements of a given application. The number of tube sections will typically be 2-5, although more sections could be possible.

Figure 1A:
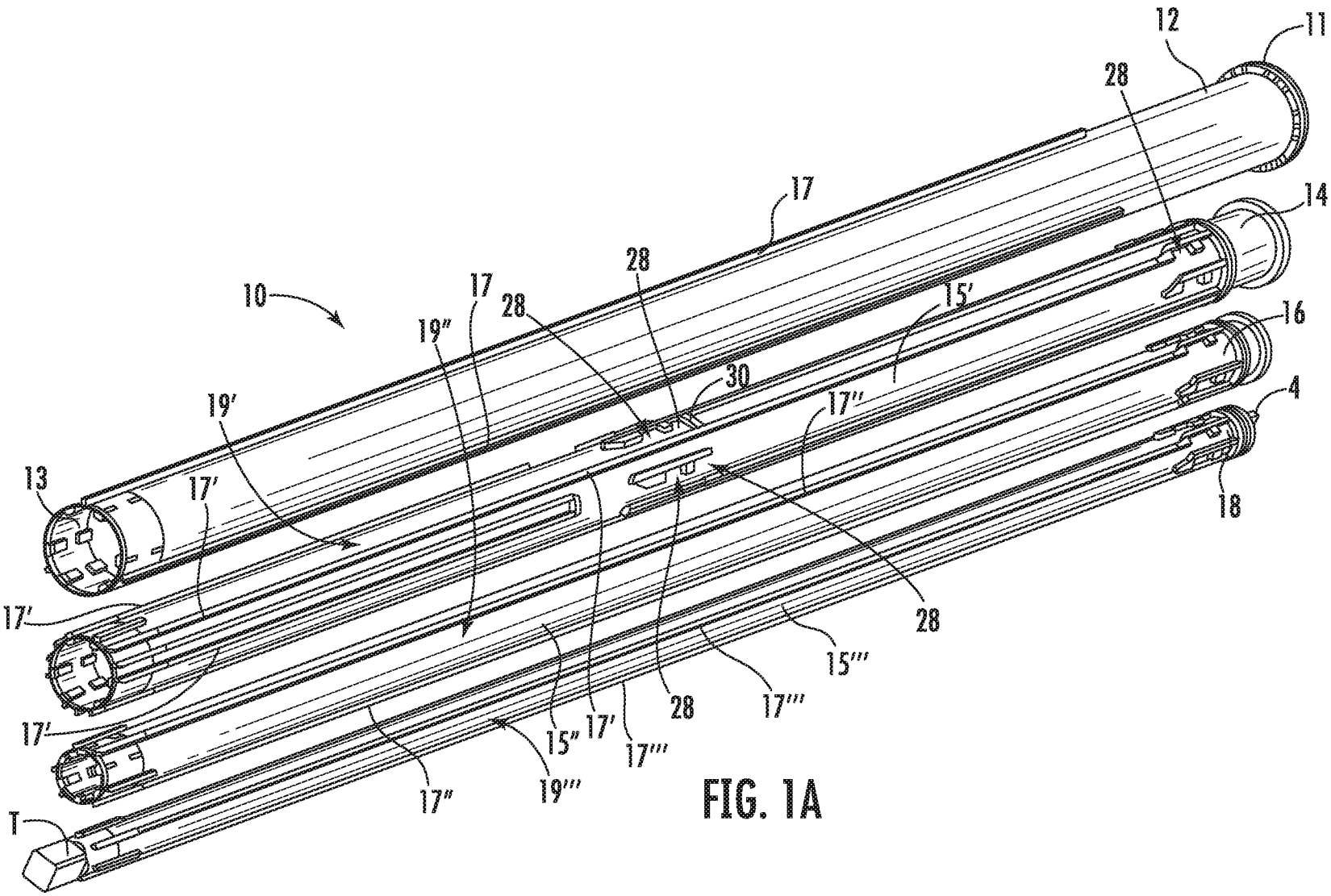
FIG. 1A is an elevated perspective view of four tube sections of a Kelly bar in accordance with one aspect of the invention.
Figure 1B:
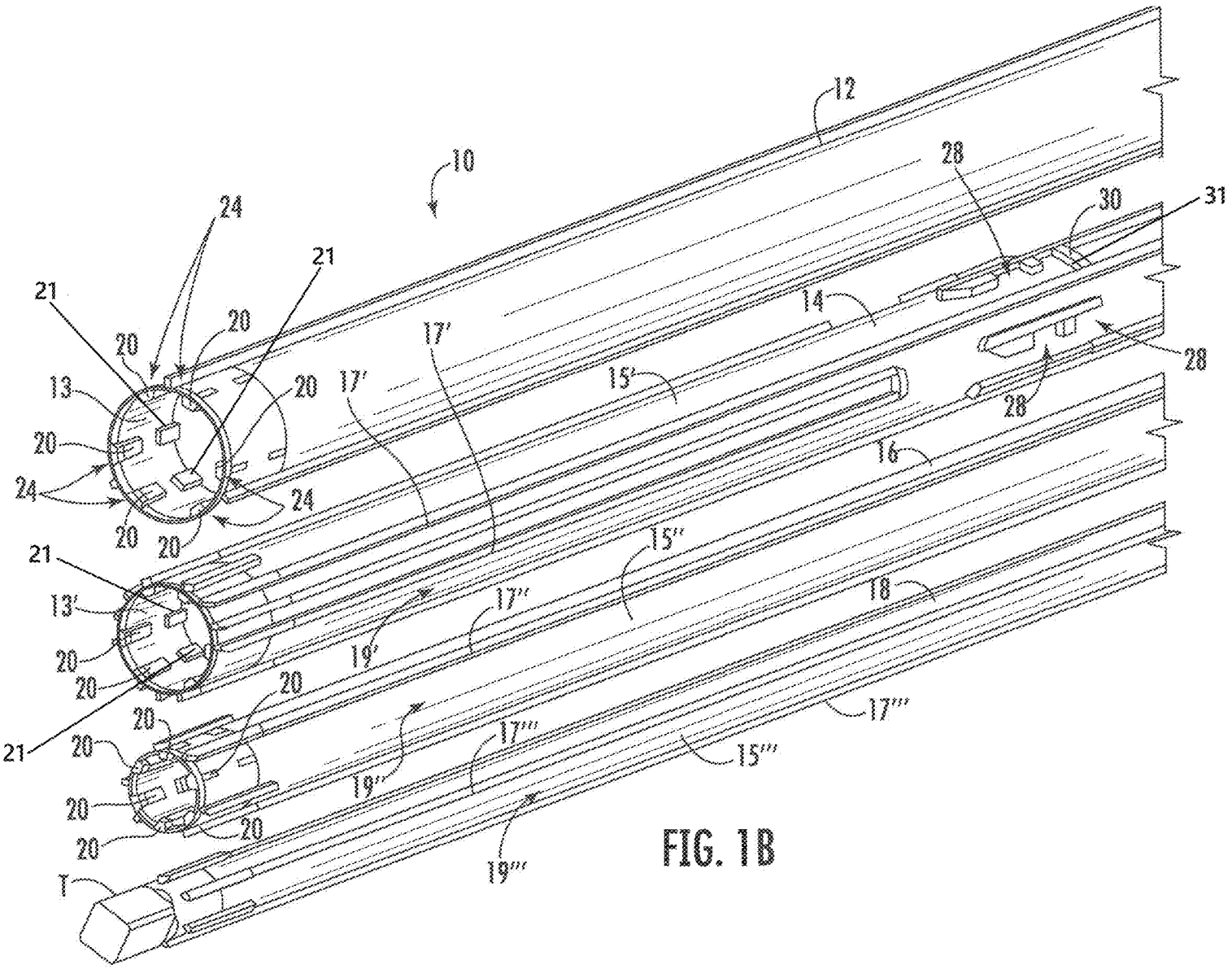
FIG. 1B is an enlarged, elevated perspective view of a portion of the tube sections of the Kelly bar illustrated in FIG. 1A.
Figure 2A:
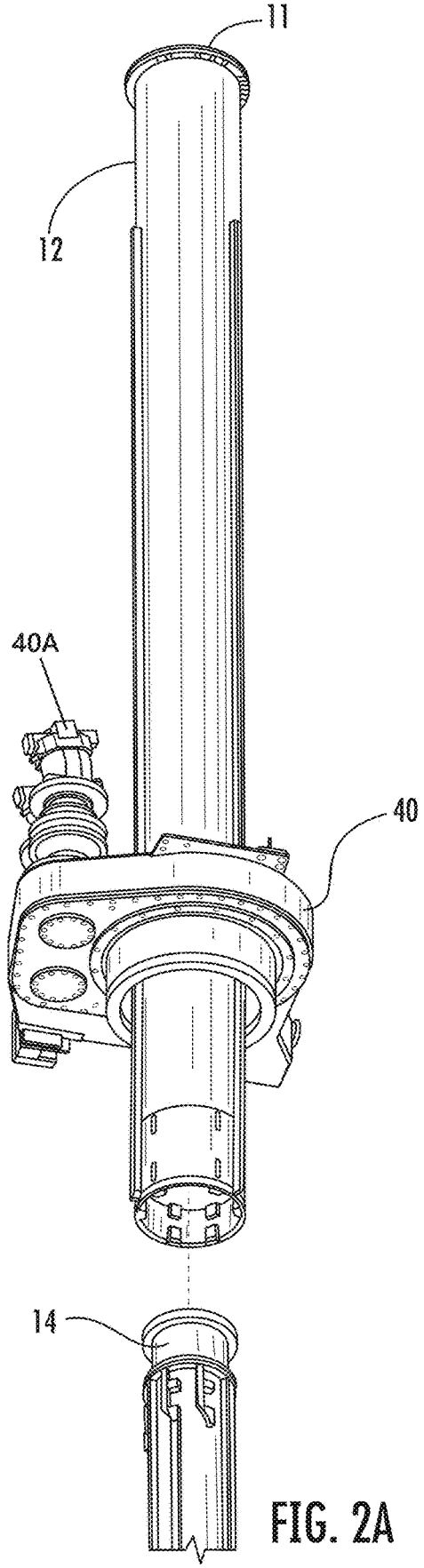
FIG. 2A is an exploded, perspective view from below of the outer tube of the Kelly bar of FIG. 1A engaged with a rotary drive coupling, and a first inner tube disengaged from the outer tube and partially broken away.
Figure 2B:
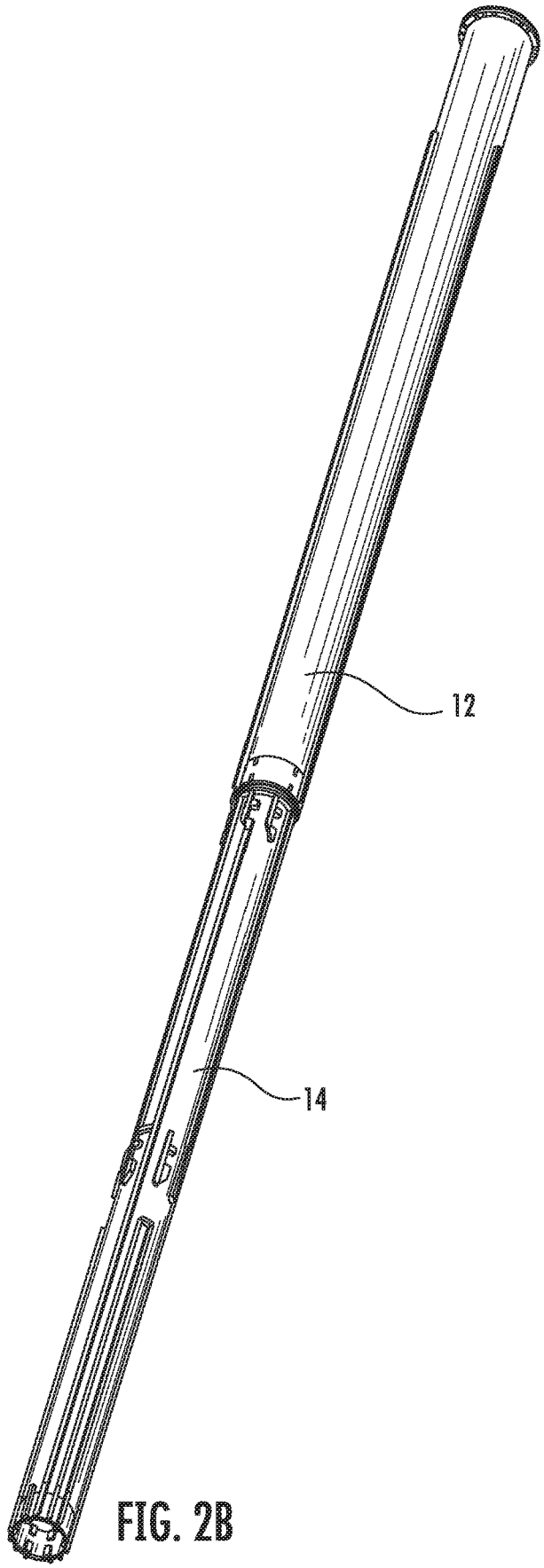
FIG. 2B is a perspective view from below of the first inner tube referenced in FIG. 2A, telescopically engaged with the outer tube of FIG. 2A.
Figure 2C:
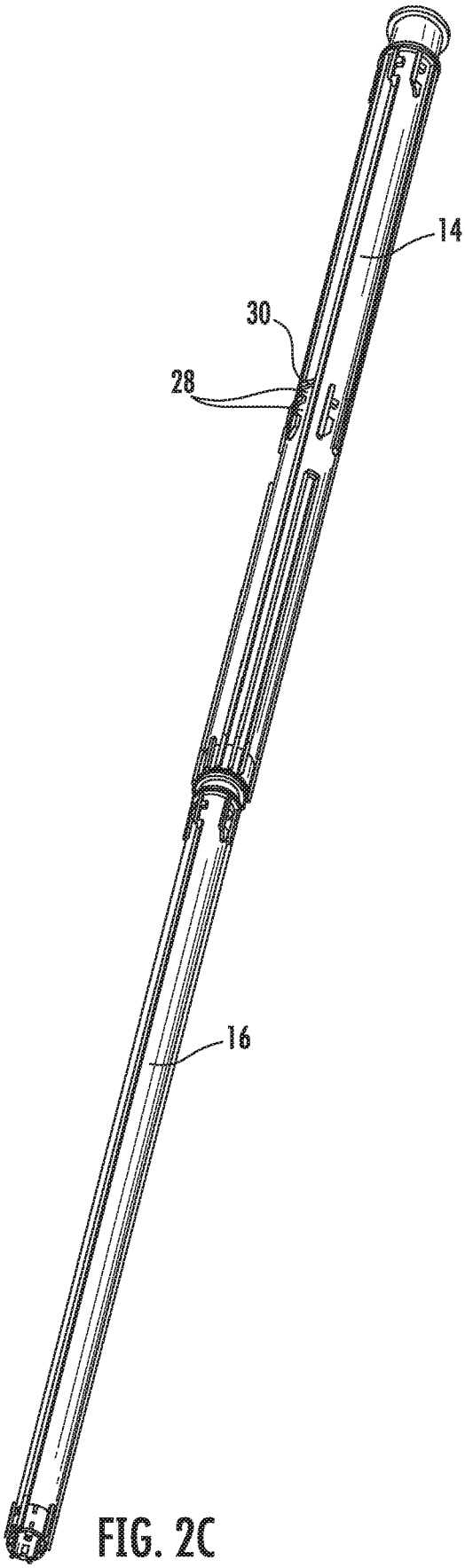
FIG. 2C is a perspective view from below of the first inner tube of FIG. 2A referenced in FIGS. 2A and 2B, telescopically engaged with the third inner tube of FIG. 1A.
Figure 2D:
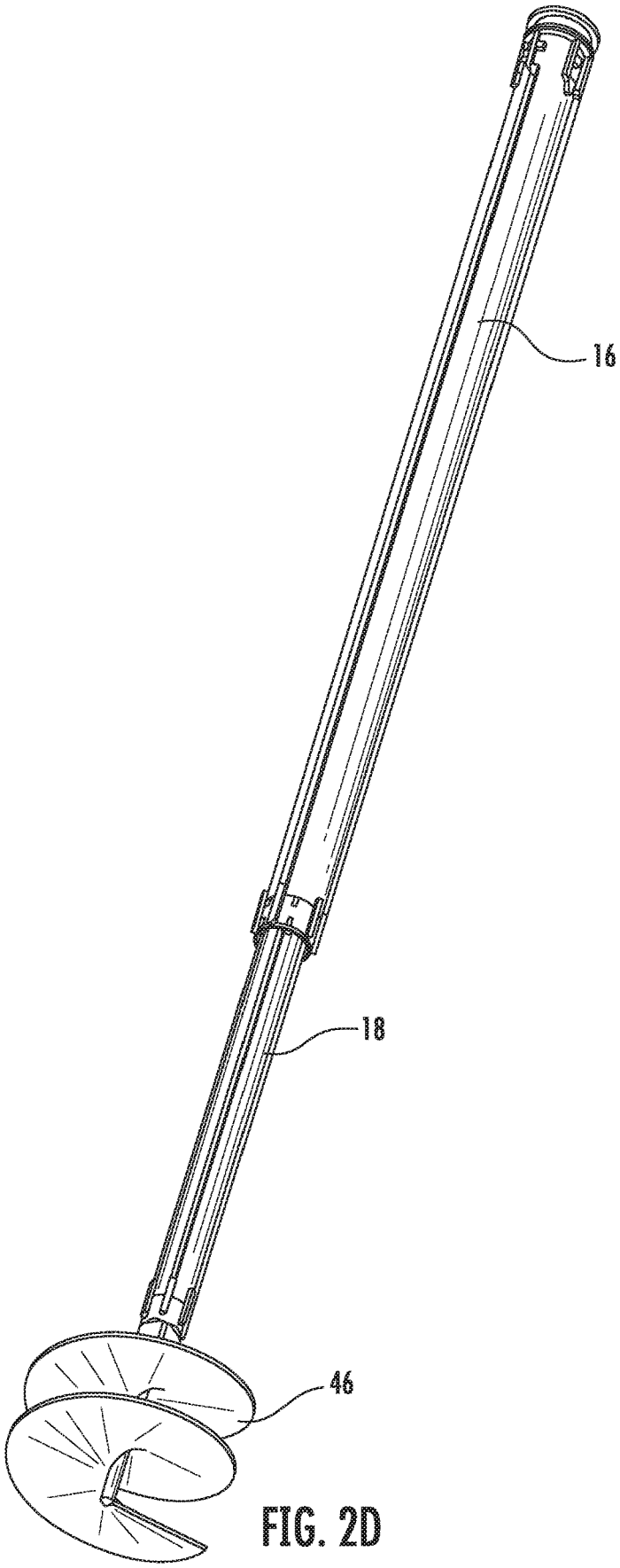
FIG. 2D is a perspective view from below of the third inner tube of FIG. 1A telescopically engaged with the innermost tube section of FIG. 1A, to which a rotary drill bit is attached.
Figure 3:
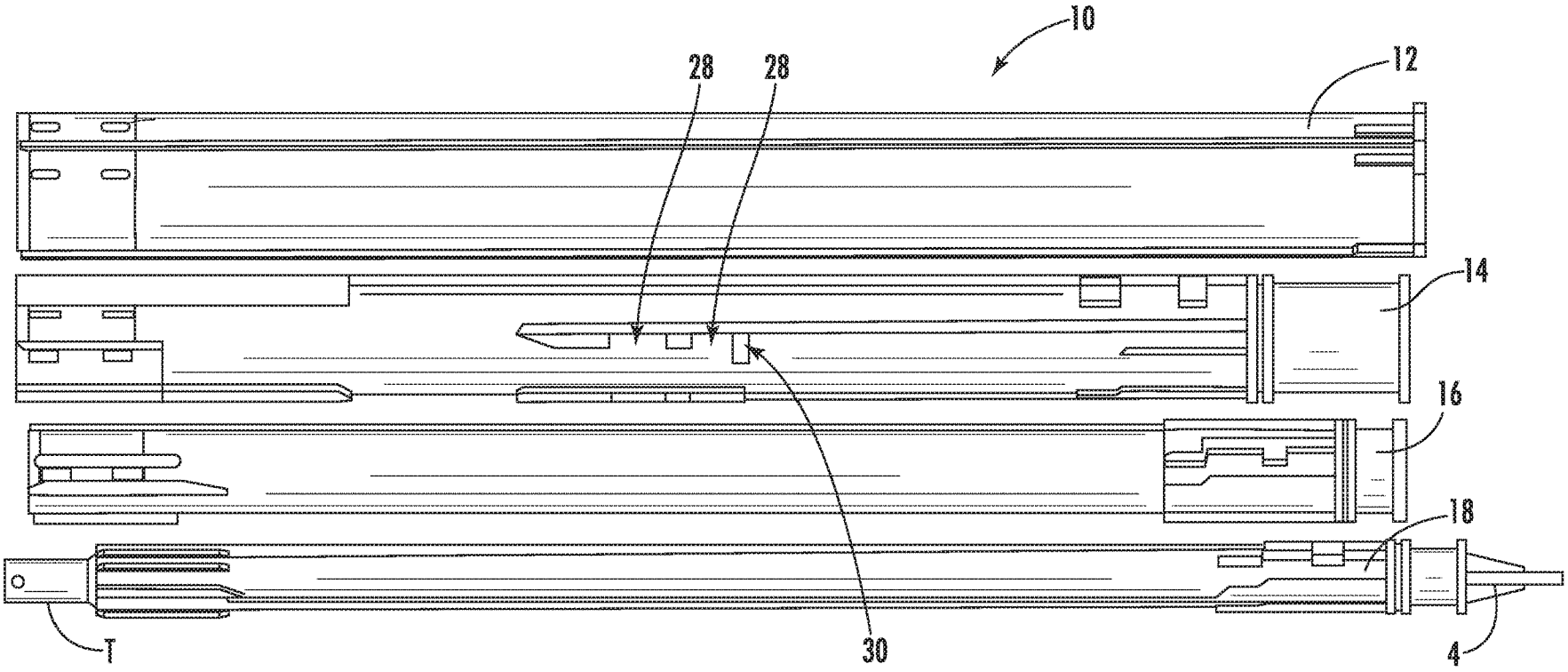
FIG. 3 is a side view of the Kelly bar tube sections of FIG. 1A.
Figure 4:
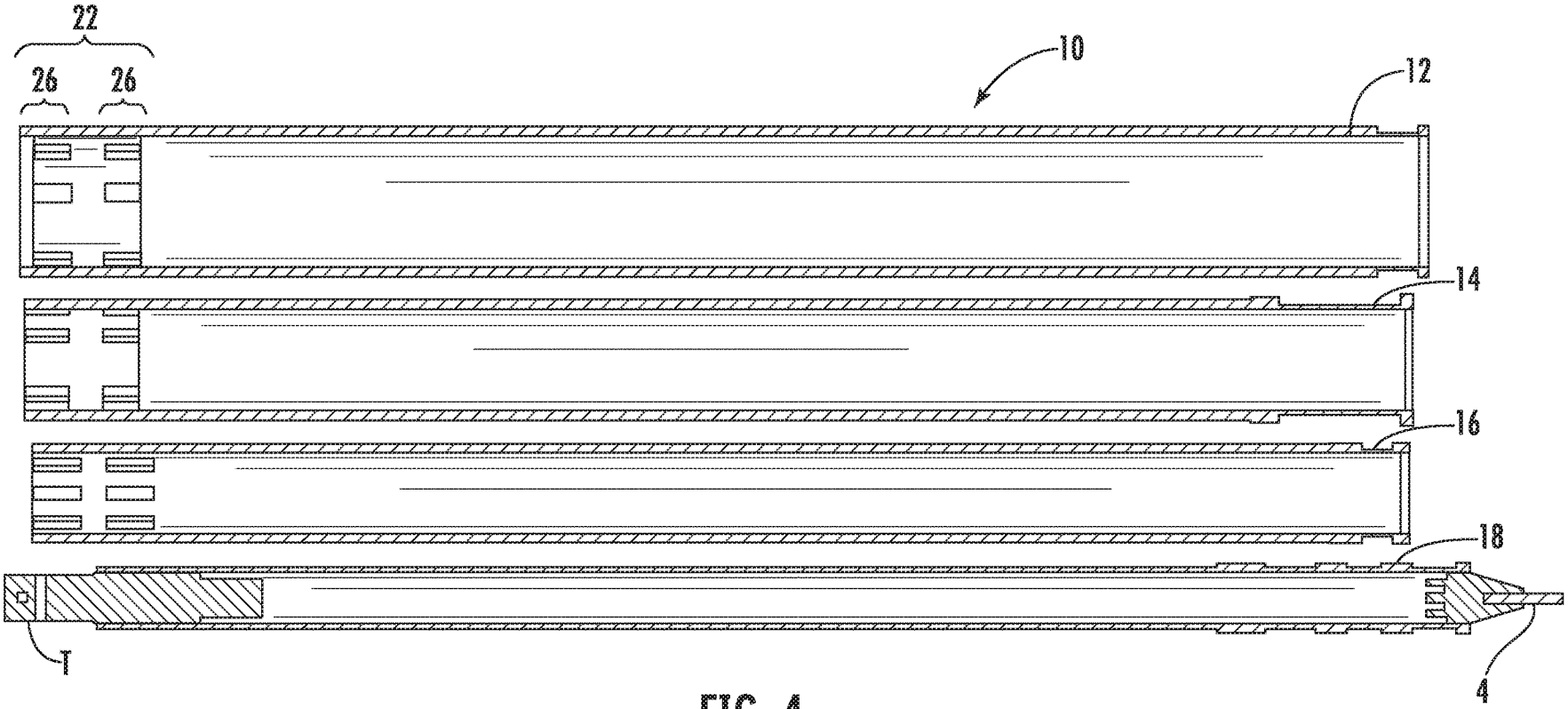
FIG. 4 is a cross-sectional view of the tube sections illustrated in FIG. 3.
Figure 5:
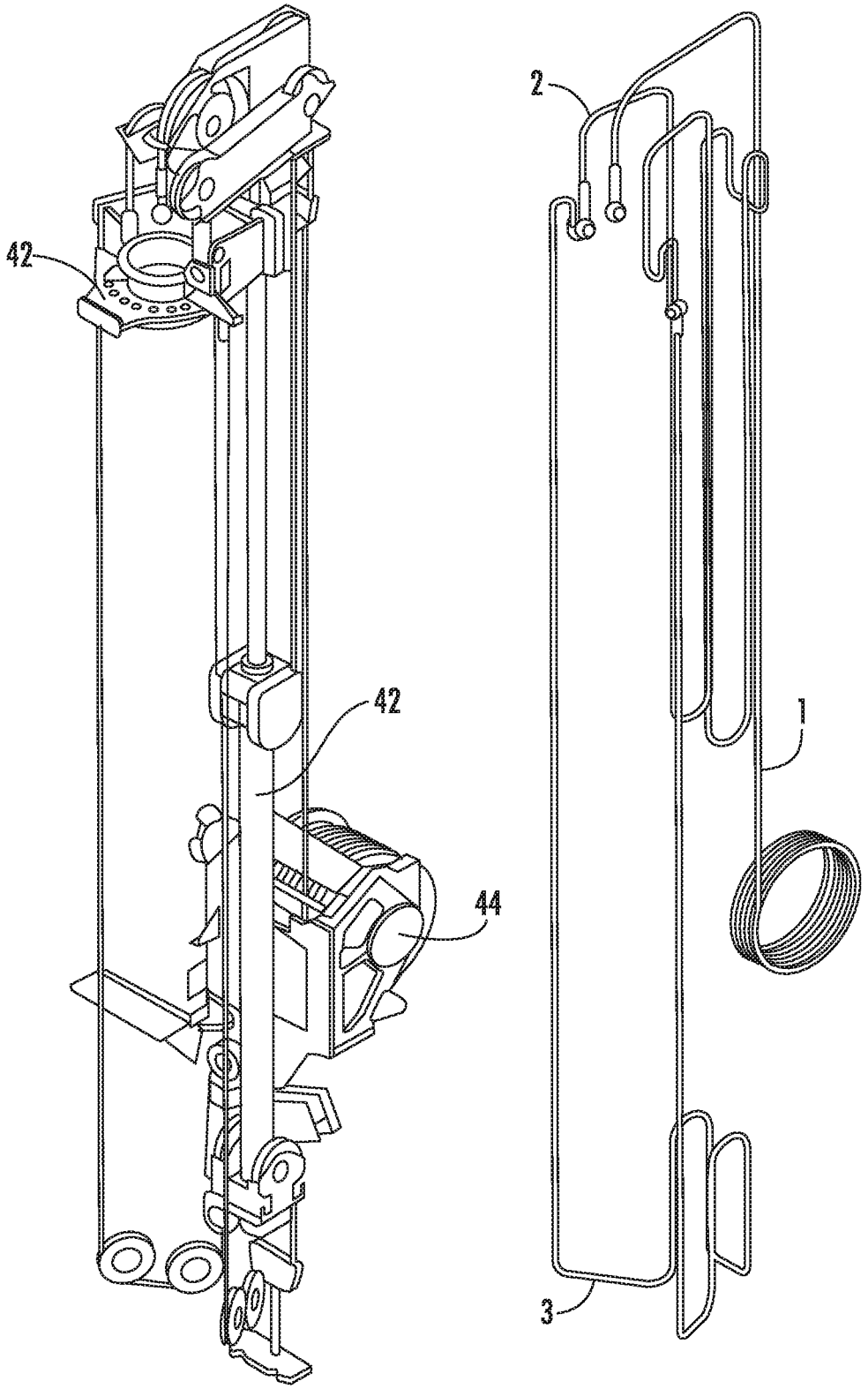
FIG. 5 is an elevated perspective view of a crowd system and hoist winch used as components of a rotary drilling system in accordance with one aspect of the invention, with the cabling extending through the system also shown separately for easy of reference.

Turning now to the accompany drawings, illustrated in FIGS. 1A, 1B and 4, is a Kelly bar apparatus 10 according to one aspect of the invention, bar apparatus 10 having four tubes (a tube being also referred to herein as a tube section), an outer tube 12, a first inner tube 14, a second inner tube 16 and a third innermost tube 18. The tube sections are of varying traverse cross-sectional diameters so that they may nest one within the next larger in traverse cross-sectional diameter, when they are placed in a telescopic arrangement during use.

Outer tube 12 forms an inner surface 13 and a plurality of keys 20 arranged into one or more key groups 22. Each key group 22 is characterized at least such that the keys 20 are arranged into a plurality (3 in the illustration) of key sets 24. Each key set 24 comprises two (or more) keys 20 circumferentially adjacent but spaced apart from one another. Each key 20 can be varied in shape, but as illustrated extends longitudinally along a portion of the outer tube 12 and radially inwardly from inner surface 13 of outer tube 12. Key sets 24 are arranged into two or more key sub-groups 26 disposed at different longitudinal positions respectively along the length of outer tube 12, each key sub-group 26 being comprised of at least two key sets 24, key sets 24 within a given one of the key sub-groups 26 being disposed at the same longitudinal position along outer tube 12 and being circumferentially spaced apart from one another. The outer surface of outer tube 12 further forms a plurality of splines 17 along its length. During use, these splines 17 and outer tube 12 interface with a rotary drive head 40 (see FIG. 4A; described in greater detail below), which is equipped with protrusions (not shown) about an inner circumference which faces the outer surface of outer tube 12 when rotary drive head 40 is installed on outer tube 12 (as shown on FIG. 4A), and the protrusions interface with splines 17 and are configured to permit rotary drive head 40 to slidably couple to outer tube 12 while also rotationally driving the splines 17 (and therefore rotationally drive outer tube 12) anywhere along the length of the outer tube 12.

First inner tube 14 is sized and configured to at least partially nest and rotate within and telescopically slide relative to outer tube 12. In the four-tube design illustrated, second inner tube 16 does the same relative to first inner tube 14, and third inner (and innermost) tube 18 does the same relative to second inner tube 16. First inner tube 14 forms an outer surface 15', wherein first inner tube 14 further comprises a plurality of flute-like splines 17' circumferentially spaced apart and extended along a longitudinal axis (A) of a portion of the first inner tube 14 and extending radially outwardly from the outer surface 15' of the first inner tube 14, so as to define at least two fillet-like gaps 19' between respective pairs of the splines 17'. Second inner tube 16 forms an outer surface 15" and further comprises a plurality of corresponding splines 17" similarly arranged and extending similarly from outer surface 15" of second inner tube 16 to define at least two fillet-like gaps 19". Third inner tube 18 likewise forms an outer surface 15''' and further comprises a plurality of corresponding splines 17''' similarly arranged and extending similarly from outer surface 15''' of third inner tube 18 to define at least two fillet-like gaps 19'''.

Each key set 24 of outer tube 12 is sized and configured to slidably engage with a respective one of the gaps 19' between splines 17' of first inner tube 14 when first inner tube 14 is nested within outer tube 12 and outer tube 12 is rotationally disposed in an unlocked position, permitting telescopic extension of first inner tube 14 relative to outer tube 12. Each key set 24 of outer tube 12 also is sized and configured to fit within a respective notch 28 formed within a respective one of splines 17' of first inner tube 14 when first inner tube 14 is nested within outer tube 12 and outer tube 12 is rotationally disposed in a locked position inhibiting telescopic extension of the first inner tube 14 relative to outer tube 12.

In the example illustrated, first inner tube 14 further comprises at least one blocking tab 30 which extends radially outwardly from the outer surface 15' of first inner tube 14 and circumferentially around a portion of first inner tube 14 so as to extend across a longitudinal axis of a respective one of the fillet-like gaps 19', and to abut a top portion 21 of at least one of the keys 20 of at least one of key sets 24 of outer tube 12 when first inner tube 14 is nested within outer tube 12 and outer tube 12 is rotationally disposed in the unlocked position and the first inner tube 14 slides into an extended telescopic position, thereby inhibiting the first inner tube 14 from telescopically extending from outer tube 12 when outer tube 12 is rotationally disposed in the unlocked position and at least one of key sets 24 of outer tube 12 is disposed in the respective one of the fillet-like gaps 19' across which the blocking tab 30 extends. A lower most abutting surface 31 of blocking tab 30 is disposed at a longitudinal midpoint of first inner tube 14, or adjacent thereto. "Adjacent" as used in this context, and throughout this disclosure and the appended claims, means within the middle one-third of the length of the first inner tube.

In the four tube section design illustrated, first inner tube 14 forms a first inner tube inner surface 13' and comprises a plurality of keys 20 circumferentially spaced apart from one another, each key 20 extending along a longitudinal axis of a portion of the first inner tube 14 and extending radially inwardly from the inner surface 13' of first inner tube 14.

It should be appreciated that, in a two tube design in accord with one aspect of this invention, there is no second or third inner tube section, and the first inner tube will not require any keys extending from an inner surface of the first inner tube. First inner tube in the two tube design will be the innermost tube, and will be equipped with a terminal end for receiving a drill bit, much like the third inner (innermost) tube of the four tube design illustrated.

As seen in FIGS. 2A-2D and 5, another aspect of the invention provides a drilling system comprised of a rotary head 40 of a rotary drive power source, a Kelly bar apparatus 10 in accord with any one of the aforesaid aspects of the invention, wherein outer tube 12 of Kelly bar apparatus 10 is coupled at a top end portion 11 of outer tube 12 to axial force means in the form of crowd system 42 and cables 2 and 3 (FIG. 5) for controllably applying an axial force to outer tube 12 in both directions of a longitudinal axis thereof, lifting means in the form of winch 44 and cable 1 (FIG. 5) for controllably retracting the innermost tube (which is the first inner tube 14 in a two tube section design, or the sequentially innermost tube in a design of three or more tube sections; third inner tube 18 of the illustrated four tube section design) via cable coupling 4 into a telescopically retracted position, and a drilling tool or bit 46 coupled to a terminal end T of innermost inner tube (18 in a four tube section design, 14 in a two tube section design) of Kelly bar apparatus 10.

In practice of the method of drilling a subterranean bore in a geologic formation in accordance with the invention, Kelly bar 10 typically is slidably coupled to hydraulic rotary drive power source 40A via rotary head 40 anywhere along the length of outer tube 12; drill bit 46 is coupled to terminal end T of first (or innermost) inner tube 18 of Kelly bar apparatus 10. Outer tube 12 is rotated by actuation of rotary drive power source 40A via rotary head 40, into an unlocked position so that first inner tube 14 drops into an extended telescoping position. Outer tube 12 is rotationally positioned (via rotary head 40) so that keys 20 of outer tube 12 each align with their respective notch 28 in splines 17' of first inner tube 14 and outer tube 12 is rotated into a locked position; and rotary drive power source 40A via rotary head 40 and crowd system 42 are actuated to respectively rotate and apply a linear load to Kelly bar apparatus 10 while outer tube 12 is in the locked position and drill bit 46 is in contact with the formation.

Figure 6A:
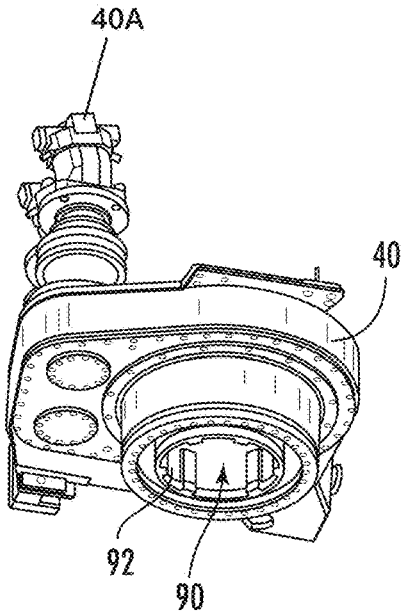
FIG. 6A is a lower view in perspective of a rotary drive and rotary head of an alternative aspect of the invention.
Figure 6B:
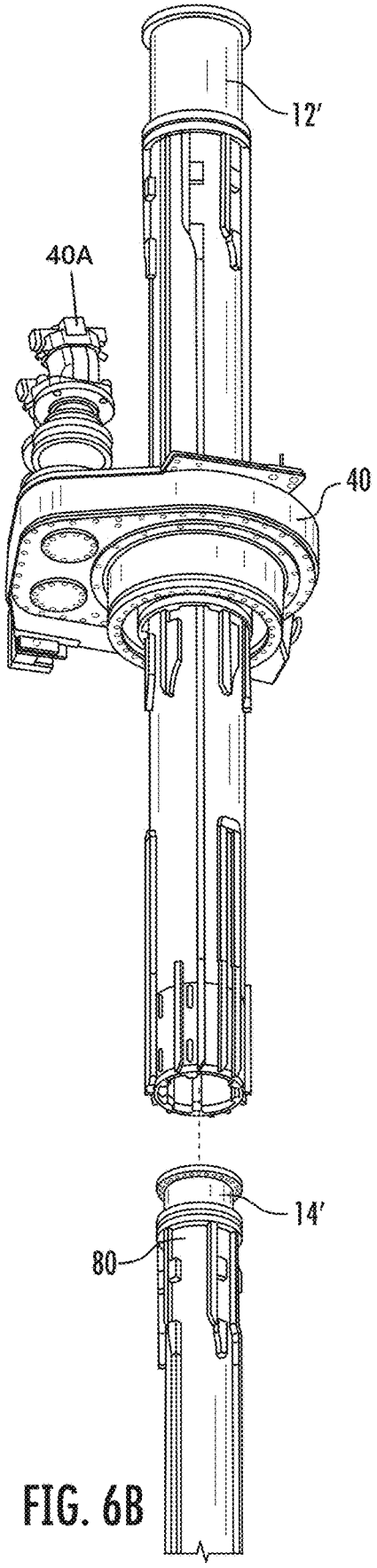
FIG. 6B is a lower view in perspective of the rotary drive and rotary head of FIG. 6A having disposed therein a first outer tube and first inner tube of the alternative aspect of the invention of FIG. 6A.

In an alternative aspect of the invention illustrated on FIGS. 6A and 6B, the outer surface of the outer tube 12' is configured with splines and notches and blocking tabs in the same way and position as described above and illustrated on the accompanying figures with respect to the outer surface of the first inner tube 14. This way, the rotary head 40's protrusions (at an inner surface 92 of Kelly bar interface 90) function as keys, key-subgroups and key groups like the plurality of keys illustrated structurally on the inner surface 13 at the lower end of the outer tube 12 in the accompanying figures. In this way, the locking and unlocking takes place at the interface between the protrusions of the rotary head 40 (i.e., at inner surface 92 of the Kelly bar interface 90 of the rotary head 40) and the splines of the outer surface of the outer tube 12' (which is modified to be per tube 14 as illustrated and discussed previously with respect to FIG. 1A), in addition to at the interface of the keys of the inner surface of the outer tube 12' and an outer surface 80 of a first inner tube 14' (which is configured like tube 16 from the prior figures). In addition, another aspect of the invention would be as illustrated in the previous figures, or as otherwise described in this specification, or as mentioned as an alternative in this paragraph above, but with the additional feature that the protrusions of the rotary drive head 40 (i.e., the protrusions of the inner surface 92 of the Kelly bar interface 90 of the rotary head 40) would be configured structurally to provide the same array of key structures as illustrated or otherwise described in this specification for the keys of the inner surface 13 of the outer tube 12 in the previous figures. This would provide the rotary drive head 40 (at the inner surface 92 of its Kelly bar interface 90) and its protrusions with the same benefits of structural integrity that the keys, key sets, key-sub groups and key groups provide to the illustrated aspect of the invention in the previous figures.

In view of the foregoing, it will be appreciated that the various aspects of the invention can include, for example, the following aspects:

1. A Kelly bar apparatus comprising:

an outer tube that forms an inner surface and a plurality of keys arranged into one or more key groups, wherein each key group is characterized at least such that:

the keys are arranged into a plurality of key sets, each key set comprising at least two keys circumferentially adjacent but spaced apart from one another, and each key extending longitudinally along a portion of the outer tube and radially inwardly from an inner surface of the outer tube, and the key sets are arranged into two or more key sub-groups disposed at different longitudinal positions respectively along the length of the outer tube, each key sub-group being comprised of at least two key sets, the key sets within a given one of the key sub-groups being disposed at the same longitudinal position along the outer tube and being circumferentially spaced apart from one another; and a first inner tube sized and configured to at least partially nest and rotate within and telescopically slide relative to the outer tube, the first inner tube forming an outer surface, wherein the first inner tube further comprises a plurality of flute-like splines circumferentially spaced apart and extended along a longitudinal axis of a portion of the first inner tube and extending radially outwardly from the outer surface of the first inner tube, so as to define at least two fillet-like gaps between respective pairs of the splines; and wherein each key set of the outer tube is sized and configured to slidably engage with a respective one of the gaps between the splines of the first inner tube when the first inner tube is nested within the outer tube and the outer tube is rotationally disposed in an unlocked position permitting telescopic extension of the first inner tube relative to the outer tube, and wherein each key set of the outer tube is sized and configured to fit within a respective notch formed within a respective one of the splines of the first inner tube when the first inner tube is nested within the outer tube and the outer tube is rotationally disposed in a locked position inhibiting telescopic extension of the first inner tube relative to the outer tube.

2. The Kelly bar apparatus according to Aspect 1, wherein the first inner tube further comprises at least one blocking tab which extends radially outwardly from the outer surface of the first inner tube and circumferentially around a portion of the first inner tube so as to extend across a longitudinal axis of a respective one of the fillet-like gaps, and to abut a top portion of at least one of the keys of at least one of the key sets of the outer tube when the first inner tube is nested within the outer tube and the outer tube is rotationally disposed in the unlocked position and the first inner tube slides into an extended telescopic position, thereby inhibiting the first inner tube from telescopically extending from the outer tube when the outer tube is rotationally disposed in the unlocked position and at least one of the key sets of the outer tube is disposed in the respective one of the fillet-like gaps across which the blocking tab extends.

3. The Kelly bar apparatus according to Aspect 2, wherein the first inner tube forms a first inner tube inner surface and comprises a plurality of keys circumferentially spaced apart from one another, each key extending along a longitudinal axis of a portion of the first inner tube and extending radially inwardly from the inner surface of the first inner tube; and wherein the Kelly bar apparatus further comprises:

a second inner tube sized and configured to at least partially nest and rotate within and telescopically slide relative to the first inner tube, the second inner tube forming an outer surface thereof, wherein the second inner tube further comprises a plurality of flute-like splines circumferentially spaced apart and extended along a longitudinal axis of a portion of the second inner tube and extending radially outwardly from the outer surface of the second inner tube, so as to define one or more fillet-like gaps between the splines of the second inner tube.

4. The Kelly bar apparatus according to Aspect 3, wherein a lower most abutting surface of the at least one blocking tab is disposed at or adjacent to a longitudinal midpoint of the first inner tube.

5. The Kelly bar apparatus according to Aspect 2, wherein a lower most abutting surface of the at least one blocking tab is disposed at or adjacent to a longitudinal midpoint of the first inner tube.

6. The Kelly bar apparatus according to Aspect 1, wherein the first inner tube forms an first inner tube inner surface and comprises a plurality of keys circumferentially spaced apart from one another, each key extending along a longitudinal axis of a portion of the first inner tube and extending radially inwardly from the inner surface of the first inner tube; and wherein the Kelly bar apparatus further comprises:

a second inner tube sized and configured to at least partially nest and rotate within and telescopically slide relative to the first inner tube, the second inner tube forming an outer surface thereof, wherein the second inner tube further comprises a plurality of flute-like splines circumferentially spaced apart and extended along a longitudinal axis of a portion of the second inner tube and extending radially outwardly from the outer surface of the second inner tube, so as to define one or more fillet-like gaps between the splines of the second inner tube.

7. A Kelly bar apparatus comprising an outer tube that forms an inner surface and a plurality of keys extending therefrom; and a first inner tube sized and configured to at least partially nest and rotate within and telescopically slide relative to the outer tube, the first inner tube forming an outer surface, wherein the first inner tube further comprises a plurality of flute-like splines circumferentially spaced apart and extended along a longitudinal axis of a portion of the first inner tube and extending radially outwardly from the outer surface of the first inner tube, so as to define at least two fillet-like gaps between respective pairs of the splines;

wherein each key of the outer tube is sized and configured to slidably engage with a respective one of the gaps between the splines of the first inner tube when the first inner tube is nested within the outer tube and the outer tube is rotationally disposed in an unlocked position permitting telescopic extension of the first inner tube relative to the outer tube, and wherein each key of the outer tube is sized and configured to fit within a respective notch formed within a respective one of the splines of the first inner tube when the first inner tube is nested within the outer tube and the outer tube is rotationally disposed in a locked position inhibiting telescopic extension of the first inner tube relative to the outer tube; and wherein the first inner tube further comprises at least one blocking tab which extends radially outwardly from the outer surface of the first inner tube and circumferentially around a portion of the first inner tube so as to extend across a longitudinal axis of a respective one of the fillet-like gaps, and to abut a top portion of at least one or more of the keys of the outer tube when the first inner tube is nested within the outer tube and the outer tube is rotationally disposed in the unlocked position and the first inner tube slides into an extended telescopic position, thereby inhibiting the first inner tube from telescopically extending from the outer tube when the outer tube is rotationally disposed in the unlocked position and at least one of the keys of the outer tube is disposed in the respective one of the fillet-like gaps across which the blocking tab extends.

8. The Kelly bar apparatus according to Aspect 7, wherein a lower most abutting surface of the at least one blocking tab is disposed at or adjacent to a longitudinal midpoint of the first inner tube.

9. A drilling system comprising:

a rotary drive power source, a Kelly bar apparatus in accord with any one of Aspects 1, 2, 7 and 8, wherein the outer tube of the Kelly bar apparatus is slidably coupled to the rotary drive power source, axial force means for controllably applying an axial force to the outer tube in both directions of a longitudinal axis thereof, lifting means for controllably retracting the first inner tube into a telescopically retracted position, and a drill bit coupled to a terminal end of the first inner tube of the Kelly bar apparatus.

10. A drilling system comprising:

a rotary drive power source, a Kelly bar apparatus in accord with any of Aspects 3 through 6, wherein the outer tube of the Kelly bar apparatus is slidably coupled, to the rotary drive power source, axial force means for controllably applying an axial force to the outer tube in both directions of a longitudinal axis thereof, lifting means for controllably retracting the first inner tube into a telescopically retracted position, and a drill bit coupled to a terminal end of the second inner tube of the Kelly bar apparatus.

11. The drilling system according to either of Aspects 9 and 10, wherein the axial force means comprises a crowd system.

12. The drilling system according to Aspect 11, wherein the lifting means comprises a winch.

13. A method of drilling a subterranean bore in a geologic formation, comprising coupling a Kelly bar apparatus in accord with any one of Aspects 1, 2, 7 and 8 to both axial force means for controllably applying an axial force to the outer tube in both directions of a longitudinal axis thereof, and a rotary drive power source slidably coupled to the outer tube of the Kelly bar;

coupling a drill bit to a terminal end of an innermost tube of the Kelly bar apparatus;

rotating the outer tube of the Kelly bar apparatus into an unlocked position so that the first inner tube is placed into an extended telescoping position;

positioning the outer tube of the Kelly bar apparatus so that the keys of the outer tube each align with their respective notch in the splines of the first inner tube and rotating the outer tube into a locked position, and actuating the rotary drive power source to rotate and apply a load to the Kelly bar apparatus while the outer tube is in the locked position and the drill bit is in contact with the formation.

14. The method according to Aspect 13, wherein the axial force means comprises a crowd system.

15. A drilling system comprising:

a rotary drive power source that comprises a Kelly bar interface that forms an inner surface and a plurality of keys arranged into one or more key groups, wherein each key group is characterized at least such that:

the keys are arranged into a plurality of key sets, each key set comprising at least two keys circumferentially adjacent but spaced apart from one another, and each key extending longitudinally along a portion of the Kelly bar interface and radially inwardly from an inner surface of Kelly bar interface, and the key sets are arranged into two or more key sub-groups disposed at different longitudinal positions respectively along the length of the Kelly bar interface, each key sub-group being comprised of at least two key sets, the key sets within a given one of the key sub-groups being disposed at the same longitudinal position along the Kelly bar interface and being circumferentially spaced apart from one another; and a first outer tube forming an outer surface, wherein the first outer tube further comprises a plurality of flute-like splines circumferentially spaced apart and extended along a longitudinal axis of a portion of the first outer tube and extending radially outwardly from the outer surface of the first outer tube, so as to define at least two fillet-like gaps between respective pairs of the splines; and wherein each key set of the Kelly bar interface is sized and configured to slidably engage with a respective one of the gaps between the splines of the first outer tube when the first outer tube is nested within the Kelly bar interface and the Kelly bar interface is rotationally disposed in an unlocked position permitting telescopic extension of the first outer tube relative to the Kelly bar interface, and wherein each key set of the Kelly bar interface is sized and configured to fit within a respective notch formed within a respective one of the splines of the first outer tube when the first outer tube is nested within the Kelly bar interface and the Kelly bar interface is rotationally disposed in a locked position inhibiting telescopic extension of the first outer tube relative to the Kelly bar interface.

16. A drilling system comprising:

a rotary drive power source, a Kelly bar apparatus in accord with Aspect 15, wherein the outer tube of the Kelly bar apparatus is slidably coupled to the rotary drive power source, axial force means for controllably applying an axial force to the outer tube in a downward (relative to the Earth's surface) direction of a longitudinal axis thereof, lifting means for controllably retracting the first inner tube into a telescopically retracted position, and a drill bit coupled to a terminal end of the first inner tube of the Kelly bar apparatus.

17. A Kelly bar apparatus comprising a rotary drive power source that comprises a Kelly bar interface that forms an inner surface and a plurality of keys extending therefrom; and a first outer tube sized and configured to at least partially nest and rotate within and telescopically slide relative to the Kelly bar interface, the first outer tube forming an outer surface, wherein the first outer tube further comprises a plurality of flute-like splines circumferentially spaced apart and extended along a longitudinal axis of a portion of the first outer tube and extending radially outwardly from the outer surface of the first outer tube, so as to define at least two fillet-like gaps between respective pairs of the splines; wherein each key of the Kelly bar interface is sized and configured to slidably engage with a respective one of the gaps between the splines of the first outer tube when the first outer tube is nested within the Kelly bar interface and the Kelly bar interface is rotationally disposed in an unlocked position permitting telescopic extension of the first outer tube relative to the Kelly bar interface, and wherein each key of the Kelly bar interface is sized and configured to fit within a respective notch formed within a respective one of the splines of the first outer tube when the first outer tube is nested within the Kelly bar interface and the Kelly bar interface is rotationally disposed in a locked position inhibiting telescopic extension of the first outer tube relative to the Kelly bar interface; and wherein the first outer tube further comprises at least one blocking tab which extends radially outwardly from the outer surface of the first outer tube and circumferentially around a portion of the first outer tube so as to extend across a longitudinal axis of a respective one of the fillet-like gaps, and to abut a top portion of at least one or more of the keys of the Kelly bar interface when the first outer tube is nested within the Kelly bar interface and the Kelly bar interface is rotationally disposed in the unlocked position and the first outer tube slides into an extended telescopic position, thereby inhibiting the first outer tube from telescopically extending from the Kelly bar interface when the Kelly bar interface is rotationally disposed in the unlocked position and at least one of the keys of the Kelly bar interface is disposed in the respective one of the fillet-like gaps across which the blocking tab extends.

18. A drilling system comprising:

a rotary drive power source, a Kelly bar apparatus in accord with Aspect 18, wherein the outer tube of the Kelly bar apparatus is slidably coupled to the rotary drive power source, axial force means for controllably applying an axial force to the outer tube in a downward (relative to the Earth's surface) direction of a longitudinal axis thereof, lifting means for controllably retracting the first inner tube into a telescopically retracted position, and a drill bit coupled to a terminal end of the first inner tube of the Kelly bar apparatus.

19. A method of drilling a subterranean bore in a geologic formation, comprising coupling a Kelly bar apparatus in accord with any one of Aspects 15-18 to both axial force means for controllably applying an axial force to the first outer tube in a downward (relative to Earth's surface) direction of a longitudinal axis thereof, and a rotary drive power source slidably coupled to the first outer tube of the Kelly bar;

coupling a drill bit to a terminal end of the innermost tube of the Kelly bar apparatus;

rotating a rotary head of the rotary drive power source of the Kelly bar apparatus into an unlocked position so that the first outer tube is placed into an extended telescoping position;

positioning the rotary head of the rotary drive power source of the Kelly bar apparatus so that the keys of the inner surface of the Kelly bar interface each align with their respective notch in the splines of the first outer tube and rotating the rotary head into a locked position, and actuating the rotary drive power source to rotate and apply a load to the Kelly bar apparatus while the Kelly bar interface of the rotary head is in the locked position and the drill bit is in contact with the formation.

20. The method according to Aspect 19, wherein the axial force means comprises a crowd system.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise. Furthermore, aspects of the invention may comprise, consistent essentially of, or consist of the indicated elements or method steps.

The invention is susceptible to considerable variation within the spirit and scope of the appended claims, which also form a part of this disclosure.

The invention claimed is:

1. A Kelly bar apparatus comprising:

an outer tube that forms an inner surface and a plurality of keys arranged into one or more key groups, wherein each key group is characterized at least such that:

the keys are arranged into a plurality of key sets, each key set comprising at least two keys circumferentially adjacent but spaced apart from one another, and each key extending longitudinally along a portion of the outer tube and radially inwardly from an inner surface of the outer tube, and the key sets are arranged into two or more key sub-groups disposed at different longitudinal positions respectively along the length of the outer tube, each key sub-group being comprised of at least two key sets, the key sets within a given one of the key sub-groups being disposed at the same longitudinal position along the outer tube and being circumferentially spaced apart from one another; and a first inner tube sized and configured to at least partially nest and rotate within and telescopically slide relative to the outer tube, the first inner tube forming an outer surface, wherein the first inner tube further comprises a plurality of flute-like splines circumferentially spaced apart and extended along a longitudinal axis of a portion of the first inner tube and extending radially outwardly from the outer surface of the first inner tube, so as to define at least two fillet-like gaps between respective pairs of the splines; and wherein each key set of the outer tube is sized and configured to slidably engage with a respective one of the gaps between the splines of the first inner tube when the first inner tube is nested within the outer tube and the outer tube is rotationally disposed in an unlocked position permitting telescopic extension of the first inner tube relative to the outer tube, and wherein each key set of the outer tube is sized and configured to fit within a respective notch formed within a respective one of the splines of the first inner tube when the first inner tube is nested within the outer tube and the outer tube is rotationally disposed in a locked position inhibiting telescopic extension of the first inner tube relative to the outer tube.

2. The Kelly bar apparatus according to claim 1, wherein the first inner tube further comprises at least one blocking tab which extends radially outwardly from the outer surface of the first inner tube and circumferentially around a portion of the first inner tube so as to extend across a longitudinal axis of a respective one of the fillet-like gaps, and to abut a top portion of at least one of the keys of at least one of the key sets of the outer tube when the first inner tube is nested within the outer tube and the outer tube is rotationally disposed in the unlocked position and the first inner tube slides into an extended telescopic position, thereby inhibiting the first inner tube from telescopically extending from the outer tube when the outer tube is rotationally disposed in the unlocked position and at least one of the key sets of the outer tube is disposed in the respective one of the fillet-like gaps across which the blocking tab extends.

3. The Kelly bar apparatus according to claim 2, wherein the first inner tube forms a first inner tube inner surface and comprises a plurality of keys circumferentially spaced apart from one another, each key extending along a longitudinal axis of a portion of the first inner tube and extending radially inwardly from the inner surface of the first inner tube; and wherein the Kelly bar apparatus further comprises:

a second inner tube sized and configured to at least partially nest and rotate within and telescopically slide relative to the first inner tube, the second inner tube forming an outer surface thereof, wherein the second inner tube further comprises a plurality of flute-like splines circumferentially spaced apart and extended along a longitudinal axis of a portion of the second inner tube and extending radially outwardly from the outer surface of the second inner tube, so as to define one or more fillet-like gaps between the splines of the second inner tube.

4. The Kelly bar apparatus according to claim 3, wherein a lower most abutting surface of the at least one blocking tab is disposed at or adjacent to a longitudinal midpoint of the first inner tube.

5. A drilling system comprising:

a rotary drive power source, a Kelly bar apparatus in accord with claim 3, wherein the outer tube of the Kelly bar apparatus is slidably coupled, to the rotary drive power source, axial force means for controllably applying an axial force to the outer tube in both directions of a longitudinal axis thereof, lifting means for controllably retracting the first inner tube into a telescopically retracted position, and a drill bit coupled to a terminal end of the second inner tube of the Kelly bar apparatus.

6. The Kelly bar apparatus according to claim 2, wherein a lower most abutting surface of the at least one blocking tab is disposed at or adjacent to a longitudinal midpoint of the first inner tube.

7. The Kelly bar apparatus according to claim 1, wherein the first inner tube forms an first inner tube inner surface and comprises a plurality of keys circumferentially spaced apart from one another, each key extending along a longitudinal axis of a portion of the first inner tube and extending radially inwardly from the inner surface of the first inner tube; and wherein the Kelly bar apparatus further comprises:

a second inner tube sized and configured to at least partially nest and rotate within and telescopically slide relative to the first inner tube, the second inner tube forming an outer surface thereof, wherein the second inner tube further comprises a plurality of flute-like splines circumferentially spaced apart and extended along a longitudinal axis of a portion of the second inner tube and extending radially outwardly from the outer surface of the second inner tube, so as to define one or more fillet-like gaps between the splines of the second inner tube.

8. A drilling system comprising:

a rotary drive power source, a Kelly bar apparatus in accord with claim 1, wherein the outer tube of the Kelly bar apparatus is slidably coupled to the rotary drive power source, axial force means for controllably applying an axial force to the outer tube in both directions of a longitudinal axis thereof, lifting means for controllably retracting the first inner tube into a telescopically retracted position, and a drill bit coupled to a terminal end of the first inner tube of the Kelly bar apparatus.

9. The drilling system according to claim 8, wherein the axial force means comprises a crowd system.

10. The drilling system according to claim 9, wherein the lifting means comprises a winch.

11. A method of drilling a subterranean bore in a geologic formation, comprising coupling a Kelly bar apparatus in accord with claim 1 to both axial force means for controllably applying an axial force to the outer tube in both directions of a longitudinal axis thereof, and a rotary drive power source slidably coupled to the outer tube of the Kelly bar;

coupling a drill bit to a terminal end of the first inner tube of the Kelly bar apparatus;

rotating the outer tube of the Kelly bar apparatus into an unlocked position so that the first inner tube is placed into an extended telescoping position;

positioning the outer tube of the Kelly bar apparatus so that the keys of the outer tube each align with their respective notch in the splines of the first inner tube and rotating the outer tube into a locked position, and actuating the rotary drive power source to rotate and apply a load to the Kelly bar apparatus while the outer tube is in the locked position and the drill bit is in contact with the formation.

12. The method according to claim 11, wherein the axial force means comprises a crowd system.

13. A Kelly bar apparatus comprising an outer tube that forms an inner surface and a plurality of keys extending therefrom; and a first inner tube sized and configured to at least partially nest and rotate within and telescopically slide relative to the outer tube, the first inner tube forming an outer surface, wherein the first inner tube further comprises a plurality of flute-like splines circumferentially spaced apart and extended along a longitudinal axis of a portion of the first inner tube and extending radially outwardly from the outer surface of the first inner tube, so as to define at least two fillet-like gaps between respective pairs of the splines;

wherein each key of the outer tube is sized and configured to slidably engage with a respective one of the gaps between the splines of the first inner tube when the first inner tube is nested within the outer tube and the outer tube is rotationally disposed in an unlocked position permitting telescopic extension of the first inner tube relative to the outer tube, and wherein each key of the outer tube is sized and configured to fit within a respective notch formed within a respective one of the splines of the first inner tube when the first inner tube is nested within the outer tube and the outer tube is rotationally disposed in a locked position inhibiting telescopic extension of the first inner tube relative to the outer tube; and wherein the first inner tube further comprises at least one blocking tab which extends radially outwardly from the outer surface of the first inner tube and circumferentially around a portion of the first inner tube so as to extend across a longitudinal axis of a respective one of the fillet-like gaps, and to abut a top portion of at least one or more of the keys of the outer tube when the first inner tube is nested within the outer tube and the outer tube is rotationally disposed in the unlocked position and the first inner tube slides into an extended telescopic position, thereby inhibiting the first inner tube from telescopically extending from the outer tube when the outer tube is rotationally disposed in the unlocked position and at least one of the keys of the outer tube is disposed in the respective one of the fillet-like gaps across which the blocking tab extends.

14. The Kelly bar apparatus according to claim 13, wherein a lower most abutting surface of the at least one blocking tab is disposed at or adjacent to a longitudinal midpoint of the first inner tube.

15. A drilling system comprising:

a rotary drive power source, a Kelly bar apparatus in accord with claim 13, wherein the outer tube of the Kelly bar apparatus is slidably coupled to the rotary drive power source, axial force means for controllably applying an axial force to the outer tube in both directions of a longitudinal axis thereof, lifting means for controllably retracting the first inner tube into a telescopically retracted position, and a drill bit coupled to a terminal end of the first inner tube of the Kelly bar apparatus.

16. A drilling system comprising:

a rotary drive power source that comprises a Kelly bar interface that forms an inner surface and a plurality of keys arranged into one or more key groups, wherein each key group is characterized at least such that:

the keys are arranged into a plurality of key sets, each key set comprising at least two keys circumferentially adjacent but spaced apart from one another, and each key extending longitudinally along a portion of the Kelly bar interface and radially inwardly from an inner surface of Kelly bar interface, and the key sets are arranged into two or more key sub-groups disposed at different longitudinal positions respectively along the length of the Kelly bar interface, each key sub-group being comprised of at least two key sets, the key sets within a given one of the key sub-groups being disposed at the same longitudinal position along the Kelly bar interface and being circumferentially spaced apart from one another; and a first outer tube forming an outer surface, wherein the first outer tube further comprises a plurality of flute-like splines circumferentially spaced apart and extended along a longitudinal axis of a portion of the first outer tube and extending radially outwardly from the outer surface of the first outer tube, so as to define at least two fillet-like gaps between respective pairs of the splines; and wherein each key set of the Kelly bar interface is sized and configured to slidably engage with a respective one of the gaps between the splines of the first outer tube when the first outer tube is nested within the Kelly bar interface and the Kelly bar interface is rotationally disposed in an unlocked position permitting telescopic extension of the first outer tube relative to the Kelly bar interface, and wherein each key set of the Kelly bar interface is sized and configured to fit within a respective notch formed within a respective one of the splines of the first outer tube when the first outer tube is nested within the Kelly bar interface and the Kelly bar interface is rotationally disposed in a locked position inhibiting telescopic extension of the first outer tube relative to the Kelly bar interface.

17. A drilling system comprising:

a rotary drive power source, a Kelly bar apparatus in accord with claim 16, wherein the first outer tube of the Kelly bar apparatus is slidably coupled to the rotary drive power source, axial force means for controllably applying an axial force to the first outer tube in a downward (relative to the Earth's surface) direction of a longitudinal axis thereof, a first inner tube sized and configured to at least partially nest and rotate within and telescopically slide relative to the first outer tube;

lifting means for controllably retracting the first inner tube into a telescopically retracted position, and a drill bit coupled to a terminal end of the first inner tube of the Kelly bar apparatus.

18. A Kelly bar apparatus comprising a rotary drive power source that comprises a Kelly bar interface that forms an inner surface and a plurality of keys extending therefrom; and a first outer tube sized and configured to at least partially nest and rotate within and telescopically slide relative to the Kelly bar interface, the first outer tube forming an outer surface, wherein the first outer tube further comprises a plurality of flute-like splines circumferentially spaced apart and extended along a longitudinal axis of a portion of the first outer tube and extending radially outwardly from the outer surface of the first outer tube, so as to define at least two fillet-like gaps between respective pairs of the splines;

wherein each key of the Kelly bar interface is sized and configured to slidably engage with a respective one of the gaps between the splines of the first outer tube when the first outer tube is nested within the Kelly bar interface and the Kelly bar interface is rotationally disposed in an unlocked position permitting telescopic extension of the first outer tube relative to the Kelly bar interface, and wherein each key of the Kelly bar interface is sized and configured to fit within a respective notch formed within a respective one of the splines of the first outer tube when the first outer tube is nested within the Kelly bar interface and the Kelly bar interface is rotationally disposed in a locked position inhibiting telescopic extension of the first outer tube relative to the Kelly bar interface; and wherein the first outer tube further comprises at least one blocking tab which extends radially outwardly from the outer surface of the first outer tube and circumferentially around a portion of the first outer tube so as to extend across a longitudinal axis of a respective one of the fillet-like gaps, and to abut a top portion of at least one or more of the keys of the Kelly bar interface when the first outer tube is nested within the Kelly bar interface and the Kelly bar interface is rotationally disposed in the unlocked position and the first outer tube slides into an extended telescopic position, thereby inhibiting the first outer tube from telescopically extending from the Kelly bar interface when the Kelly bar interface is rotationally disposed in the unlocked position and at least one of the keys of the Kelly bar interface is disposed in the respective one of the fillet-like gaps across which the blocking tab extends.

19. A drilling system comprising:

a rotary drive power source, a Kelly bar apparatus in accord with claim 18, wherein the first outer tube of the Kelly bar apparatus is slidably coupled to the rotary drive power source, axial force means for controllably applying an axial force to the first outer tube in a downward (relative to the Earth's surface) direction of a longitudinal axis thereof, a first inner tube sized and configured to at least partially nest and rotate within and telescopically slide relative to the first outer tube, lifting means for controllably retracting the first inner tube into a telescopically retracted position, and a drill bit coupled to a terminal end of the first inner tube of the Kelly bar apparatus.

* * * * *